United States Patent [19]

Mitchell

[11] 3,949,714

[45] Apr. 13, 1976

[54] FUEL-AIR METERING AND INDUCTION SYSTEM

[75] Inventor: Harry R. Mitchell, Bloomfield Hills, Mich.

[73] Assignee: General Motors Corporation, Detroit, Mich.

[22] Filed: Apr. 22, 1974

[21] Appl. No.: 462,631

[52] U.S. Cl. .. 123/32 EA; 123/139 E; 123/140 MC

[51] Int. Cl.[2] ..... F02B 3/00

[58] Field of Search ..... 123/32 EA, 32 AE, 139 E, 123/139 AW, 140 MC:119 R

[56] References Cited

UNITED STATES PATENTS

| | | | |
|---|---|---|---|
| 2,174,547 | 10/1939 | Bailey | 251/118 |
| 3,240,191 | 3/1966 | Wallis | 123/32 EA |
| 3,650,258 | 3/1972 | Jackson | 123/139 AW |
| 3,724,435 | 4/1973 | Bier | 123/139 E |
| 3,739,762 | 6/1973 | Jackson | 123/139 AW |
| 3,813,189 | 5/1974 | Tompkins | 417/220 |
| 3,817,099 | 6/1974 | Bubniak et al. | 73/207;199 |
| 3,817,225 | 6/1974 | Priegel | 123/32 EA |
| 3,817,231 | 6/1974 | O'Neill | 123/32 EA |
| 3,823,696 | 7/1974 | Mutschler et al. | 123/32 EA |
| 3,824,983 | 7/1974 | Sciabica | 123/32 EA |
| 3,839,997 | 10/1974 | Mennesson | 123/32 EA |
| 3,867,913 | 2/1975 | Pierlot | 123/32 EA |

*Primary Examiner*—Charles J. Myhre
*Assistant Examiner*—Paul Devinsky
*Attorney, Agent, or Firm*—Arthur N. Krein

[57] ABSTRACT

A fuel-air metering and induction system for an internal combustion engine including an electronic controlled pressurized carburetion system wherein a carburetor mounted on top of the intake manifold of an internal combustion engine is provided with one or more throttle valves to regulate the flow of induction fluid therethrough with a mass airflow meter including an air metering valve mounted on a shaft for rotation in the induction passage positioned upstream thereof, the air metering valve shaft having a cam thereon to actuate the metering rod of a fuel metering valve to control the delivery of fuel to a fuel atomizing nozzle discharging fuel into the induction stream immediately downstream of the throttle valves, the fuel metering valve being supplied with high pressure fuel from an electrically controlled, high pressure fuel pump, the output pressure and therefore volume of fuel delivered to the fuel metering valve being regulated as a function of electrical signals received which are indicative of various engine operating conditions and the mass airflow through the mass airflow meter.

6 Claims, 3 Drawing Figures

FUEL-AIR METERING AND INDUCTION SYSTEM

This invention relates to a fuel-air metering and induction system for an internal combustion engine and, in particular, to such a system using an electronic controlled pressurized carburetion system.

Various fuel-air metering systems have been proposed in the prior art in an attempt to maintain the desired air-fuel ratios more precisely in order to obtain the most efficient operation of an internal combustion engine. Some of these proposals are based on the so-called "speed-density" type systems, that is, the basic airflow determination of such a system is dependent on engine speed and manifold air density as measured by manifold air pressure (vacuum) with compensation for temperature, altitude and starting enrichment. The basic design of such a so-called "speed-density" system is dependent on engine parameters such as displacement, valve overlap, exhaust dilution and other factors to convert engine speed to volumetric airflow rate. Because of this, such "speed-density" systems require the use of various other elements to compensate for the differences in volumetric efficiency of similar engines.

Other fuel-air metering systems are based on the so-called "mass-flow" type systems wherein an air valve or a venturi is used to measure airflow, together sometimes with compensation required for throttle position and engine speed. Some so-called "mass-flow" systems are very complicated electromechanical type structures which, because of the forces involved to actuate the mechanical components of such systems, suffer as to the degree of accuracy obtainable relative to the desired air-fuel ratios required during certain operating conditions of the engine and are relatively slow to react to rapid changes in the operating condition of the engine as, for example, when the engine is rapidly accelerated or decelerated. In addition, in these prior known mass-flow type systems, the butterfly valves, if used, are not accurate and, if a venturi is used in order to provide adequate signals at small airflow rates, the venturi must be relatively small thus causing an excessive pressure drop at high airflow. In addition, most such known mass-flow type systems utilize individual fuel injectors for each of the cylinders of the engine so that accurate fuel metering is not readily or economically obtained.

It is therefore a primary object of this invention to provide an improved fuel-air metering and induction system for an internal combustion engine whereby an electronic controlled pressurized carburetion system is utilized to provide the required fuel-air ratio of induction fluid that is then supplied uniformly through an inlet manifold to the cylinders of the engine.

Another object of this invention is to provide an improved fuel-air metering and induction system whereby the air-flow to the engine is measured by a scheduled area air metering valve system and controlled by a throttle valve, the air metering valve also being used to position the metering rod of a fuel metering valve whereby fuel can be accurately delivered to the engine as a function of the mass airflow rate through the scheduled air metering valve.

A still further object of this invention is to provide an improved electronic controlled pressurized carburetion system for an internal combustion engine whereby the fuel discharged from the carburetor is controlled electrically as a function of engine operating conditions and mechanically as a function of the position of the air metering valve of a mass airflow meter and other measured pressure conditions at the air and fuel metering valves.

These and other objects of the invention are obtained by a fuel-air metering and induction system for an internal combustion engine including a carburetor having a throttle controlled induction passage in communication with the induction passage in the intake manifold of the engine, a mass airflow meter including an air metering valve mounted on a valve shaft for rotation in the induction passage upstream of the throttle, an electrically controlled high pressure fuel supply, an atomizing fuel nozzle positioned to discharge fuel into the induction passage immediately downstream of the throttle valve, a variable area fuel metering valve interconnected between the high pressure fuel supply and the atomizing fuel nozzle, the fuel metering valve being actuated by a cam fixed to the shaft supporting the air metering valve to control the fuel flow metering area and thereby fuel flow to the atomizing nozzle as a function of the rotative position of the air metering valve and, an electronic control circuit is connected to the electrically controlled high pressure fuel supply to supply a variable electrical signal thereto to thereby regulate the flow and pressure of fuel to the fuel metering valve as a function of electrical signals corresponding to the airflow to the engine and of the engine operating conditions as provided by suitable sensors, whereby a predetermined air-fuel ratio can be supplied to the engine as required for particular engine operating conditions.

For a better understanding of the invention, as well as other objects and further features thereof, reference is had to the following detailed description of the invention to be read in connection with the accompanying drawings, wherein:

FIG. 1 is a schematic and functional block diagram of the fuel-air metering and induction system of an internal combustion engine utilizing an electronic controlled pressurized carburetion system and a mass-flow air meter in accordance with the invention;

Figure 2:
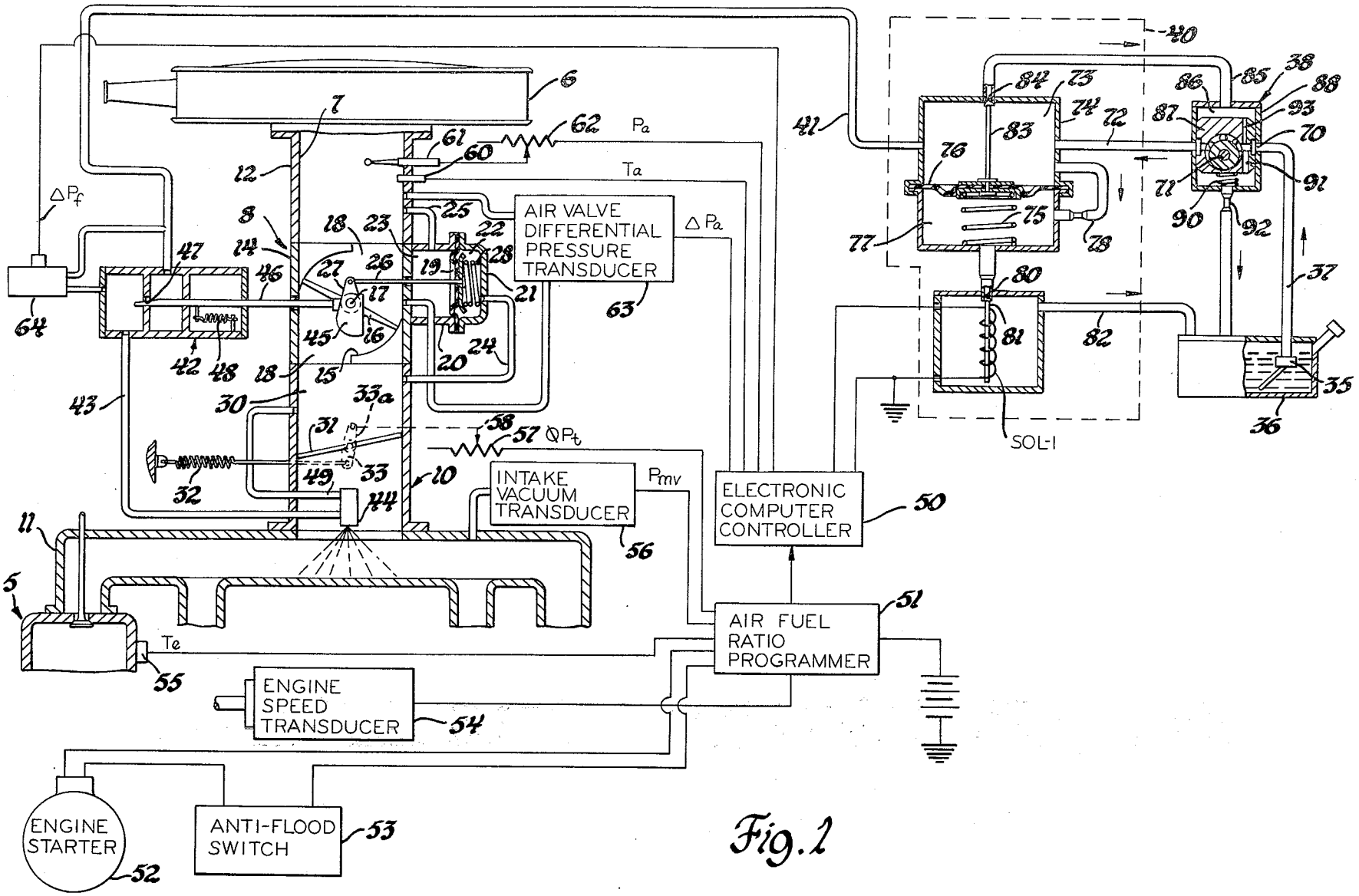
FIG. 2 is a schematic block diagram of the electronic circuit portion of the fuel-air metering and induction system of FIG. 1; and, FIG. 3 is a side view with parts broken away of a portion of the pressurized carburetor of the system to show details of the throttle plate assembly of the pressurized carburetor.
Figure 2:
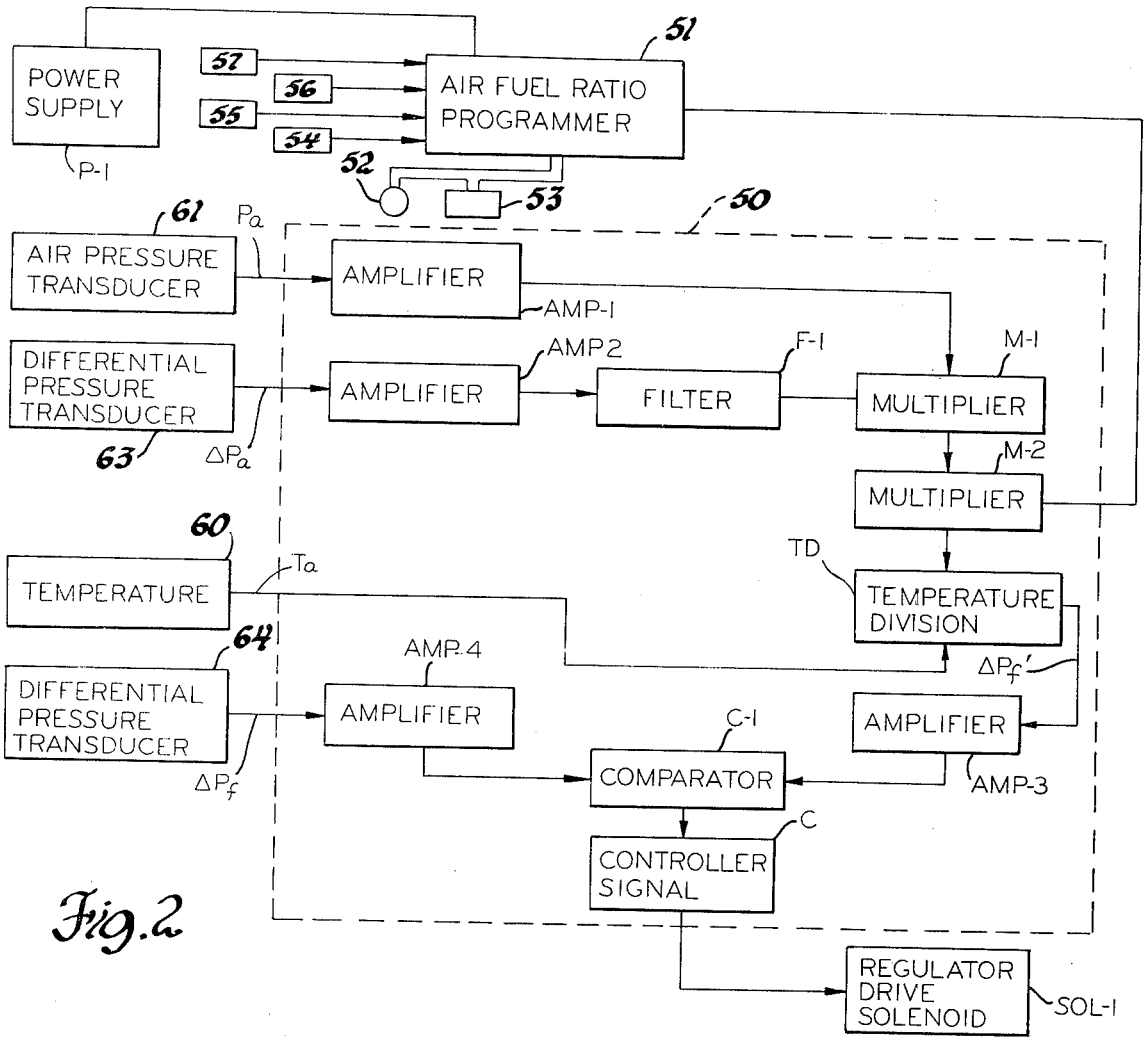

Referring first to FIG. 1, which is a schematic and functional diagram of the subject air-fuel metering and induction system, air is supplied to an internal combustion engine 5 through an air filter 6 and the induction passage 7 in an air meter assembly, generally designated 8, and through a throttle controlled, pressurized carburetor or air induction unit 10 to the intake manifold 11 of the engine.

The air meter 8 is preferably of the type disclosed in U.S. Pat. application Ser. No. 278,958, now U.S. Pat. No. 3,817,099 entitled "Mass Flow Air Meter" filed on Aug. 9, 1972 in the names of William C. Bubniak, Louis W. Heullmantel and Harry R. Mitchell and assigned to the same assignee as the subject application, the disclosure of which is incorporated herein by reference thereto. As shown, the air meter includes an air horn 12 and air valve body 14 having a cross bore 15 therein. A butterfly valve 16 mounted on a shaft 17 journalled for rotation in the valve body coaxial with cross bore 15 is used to control airflow through a pair of contoured holes 18 of continuous profile extending from opposite sides of the valve body 14 and running out at the cross bore 15, one of the contoured holes being inverted with respect to the other contoured hole, the valve 16 being operated by a servo mechanism which derives its power from the air pressure drop across the valve 16.

The servo mechanism used to position the valve 16 of the air meter to maintain essentially a constant depression across this valve, as desired, over most of the range of engine operation, is shown schematically in FIG. 1 and includes a diaphragm 19 mounted between the housing portion 20 of the air meter body and a cover 21 forming therewith chambers 22 and 23 on opposite sides of the diaphragm. Chamber 22 is connected by a conduit 24 to the induction passage downstream of the valve 16 while chamber 23 is connected by a conduit 25 to the induction passage 7 upstream of the valve 16. A control rod 26 is fixed at one end to the diaphragm 19 for movement therewith, this rod extending through a seal aperture in the housing portion 20 with its opposite end pivotally connected to a lever arm 27 operatively fixed to the valve 16, as by being secured to one end of the valve shaft 17. A spring 28 of predetermined force, as desired, is positioned to normally bias the diaphragm and, therefore, the valve 16 to a neutral position. With this arrangement, any change in the depression across the air valve 16 will be detected by the servo mechanism and the rotative position of the air valve will be adjusted accordingly.

The air induction unit or pressurized carburetor 10 is provided with an induction passage 30 in communication with induction passage 7, with flow through the passage 30 controlled, in the preferred embodiment to be described in detail hereinafter, by a pair of throttle valves 31, only one of which is illustrated schematically in FIG. 1, the throttle valves being adapted to be operated by the usual throttle pedal control, not shown, actuated by the vehicle operator, a spring 32 being fixed to a lever 33 on a throttle shaft to normally bias the throttle valves to a closed position.

Fuel for the engine is delivered at a relatively low pressure by a fuel pump 35 from a fuel reservoir 36 to a supply conduit 37. Fuel passes from the conduit 37 to the inlet side of a high pressure, variable displacement, engine driven, fuel pump 38, the fuel pump discharging fuel at a relatively high pressure to an electrically controlled valve mechanism or pressure regulator, generally designated 40, which regulates the flow of fuel to a conduit 41 for delivery to the inlet side of a variable area fuel metering valve 42, the outlet side of this fuel metering valve being connected by a conduit 43 to deliver fuel to an injector or atomizing nozzle 44 positioned in the carburetor 10 for discharge, preferably, into the induction passage 30 immediately adjacent to the downstream side of the throttle valves 31.

The throttle controlled air induction unit 10 and the atomizing nozzle 44, in effect, form a fuel-injection type pressurized carburetor which, as shown in FIG. 1, is positioned in the induction system at a considerable distance from the inlet ports of the individual cylinders or combustion chambers of the engine for discharge into the intake manifold 11 which serves as a common intake for the plurality of such cylinders. This arrangement capitalizes on the high degree of fuel atomization for more efficient mixing of fuel and air thereby resulting in better preparation of the fuel-air mixture and more efficient combustion.

Since the rotative position of the air valve 16 relative to the contoured holes 18 establishes the airflow area through the air meter 8, this rotative position of the air valve is used to control the fuel metering area through the fuel metering valve 42 in the fuel supply system. As shown, a cam 45 of predetermined profile is fixed to one end of the shaft 17 supporting the air valve 16 to act against one end of a tapered fuel metering rod 46, slidably journalled in the housing of the valve 42, to effect movement of this rod in one direction relative to an orifice passage 47 in the wall separating the intake chamber side from the discharge chamber side of the housing of valve 42, movement of the rod 46 in the opposite direction being effected by a spring 48 fixed at one end to the rod and at its other end to a fixed portion of the housing of valve 42.

The fuel injector or atomizing nozzle 44 may be of any suitable type, for example, it may be of the type disclosed in U.S. Pat. No. 3,310,240 entitled "Air Atomizing Nozzle" issued March 21, 1967 to Richard G. Grundman in which air, as supplied by a conduit 49 connected upstream of the throttle valves 31, is used to assist in atomizing the liquid fuel for discharge into the induction passage 30 downstream of the throttle valves.

The electrically controlled fuel valve mechanism 40 controls the pressure and flow of fuel supplied to the fuel metering valve 42, this control being effected by an electric signal supplied by an electronic computer controller, generally designated 50, which receives electrical signals indicative of the mass airflow rate to the engine and an electrical signal indicative of a desired air-fuel ratio from a programmer 51 which in turn receives electrical signals indicative of various engine operating parameters, in a manner to be described.

The air-fuel ratio programmer 51 and the electronic computer controller 50 may obviously take many forms to provide the required electrical output signals, that is, an output signal from the programmer 51 to controller 50 and an electric control signal from controller 50 to the electrically controlled valve mechanism 40. For example, the air-fuel ratio programmer 51 may be essentially an analog computer using, as input data, electrical signals from a number of transducers to produce as an electrical output signal to the controller 50, a voltage level indicative of the desired air-fuel ratio for a particular engine operating condition and may, for example, be of the type disclosed in U.S. Pat. No. 3,240,191 entitled "Fuel Injection System for Internal Combustion Engine" issued Mar. 15, 1966 to Kenneth B. Wallis. The electronic computer controller 50, for example, may contain analog integrated circuit multipliers, such as the Model MC 1595 multipliers commercially available from Motorola Semiconductor Products Inc., 5005 E. McDowell Road, Phoenix, Arizona 85008.

The desired air-fuel ratio signals are thus electronically provided by the programmer 51 which receives a signal from the engine starter 52 and a conventional anti-flood switch 53 circuit, a signal from the engine speed transducer 54, a signal $T_e$ of engine temperature from a temperature thermistor or transducer 55, a signal $P_{mv}$ of intake manifold pressure in manifold 11 as sensed by an intake vacuum transducer 56 and a signal indicating the position of throttle valves 31 for a fuel enrichment signal $\theta P_t$ from the throttle position transducer 57 actuated by a link 58 connected to the throttle lever 33*a*.

The air-fuel ratio programmer 51 provides an electrical signal to the electronic computer controller 50 which also receives signals from the mass airflow meter assembly 8 of the airflow to the engine, these signals indicating the inlet air temperature $T_a$ as sensed by temperature transducer 60 extending into the induction passage 7 in air horn 12 upstream of the air valve 16, a signal $P_a$ of inlet air pressure as sensed by an air pressure transducer 61 through the aneroid barometer 62 and a signal $\Delta P_a$ of the air pressure differential across the air valve 16 as sensed by the differential air pressure transducer 63 and, a signal $\Delta P_f$ of the fuel pressure differential across the fuel metering valve 42 as sensed by a differential fuel pressure transducer 64.

A system block diagram of this electronic circuit is shown in FIG. 2, a regulated power supply P-1 being used to power the system during engine operation. The atmospheric pressure transducer 61 feeds a signal $P_a$ to an amplifier AMP-1 with the output of this amplifier being fed to a multiplier M-1, this multiplier also receiving a signal $\Delta P_a$ fed from the differential air pressure transducer 63 through an amplifier AMP-2 and then through a noise filter F-1. The output signal from multiplier M-1 is fed to a multipler M-2. The air-fuel ratio programmer 51 receives the electrical signals indicative of engine operating conditions, in the manner previously described, to generate a "desired" air-fuel ratio signal, the inverse of this signal, that is, $$\frac{1}{(A/F)^2}$$

which is the second input to the multiplier M-2. The output from the multiplier M-2 is then fed to a temperature division circuit TD where this signal is divided by the signal received from the temperature transducer 60. The temperature division circuit TD then puts out a signal of the "desired" fuel differential pressure $\Delta P_f$, which is fed to an amplifier AMP-3, this amplified signal then being fed to a comparator C-1 in which this signal is compared to the signal $\Delta P_f$ fed by the differential fuel pressure transducer 64 through an amplifier AMP-4 to the comparator. The output signal from the comparator C-1 is then fed to a controller C which provides an output signal which is fed to the control or regulator drive solenoid SOL-1 of the electrically controlled valve mechanism 40.

The fuel and air metering concept used in the subject fuel-air metering and induction system is basically a variable area, mass flow type concept. That is, the mass of airflow to the engine is measured and the fuel is proportioned according to the desired air-fuel ratio. A brief description of the mathematics involved in this concept is as follows:

The mass rate of flow of a fluid through an orifice may be expressed as, $$w = A\sqrt{2g_c\rho\Delta P}$$

where $w$ = flow rate (mass/unit time)

$A$ = effective flow area (geometric flow area $x$ flow coefficient)

$g_c = 32.2$ ft-$lb_m/lb_f$-$sec^2$ $\rho$ = density of fluid $\Delta P$ = pressure drop across the orifice Denoting air with the subscript $a$ and fuel with the subscript $f$, then $$w_a = A_a\sqrt{2g_c\rho_a\Delta P_a}$$

and $$w_f = A_f\sqrt{2g_c\rho_f\Delta P_f}$$

Dividing the equation for $w_a$ by the equation for $w_f$, then $$\frac{A}{F} = \frac{w_a}{w_f} = \frac{A_a}{A_f}\sqrt{\frac{2g_c\,\rho_a\,\Delta P_a}{2g_c\,\rho_f\,\Delta P_f}}$$

where A/F = air-fuel ratio

Letting $\rho_a = P_a/R_aT_a$ from the ideal gas equation and solving for $\Delta P_f$ yields, $$\sqrt{\Delta P_f} = \left(\frac{A_a}{A_f}\right)\cdot\frac{1}{(A/F)}\sqrt{\frac{P_a\ \Delta P_a}{R_aT_a\,\rho_f}}$$

Squaring both sides of the above equation results in, $$\Delta P_f = \frac{1}{(A/F)^2}\left(\frac{A_a}{A_f}\right)^2\cdot\frac{P_a\ \Delta P_a}{R_aT_a\,\rho_f}$$

The equation for $\Delta P_f$ governs the operation of the electronic control system. Some of the terms in this equation will be taken as constant, and this procedure will be described later. It is appropriate at this point to describe the method of operation of the overall system and relate the components to their functions in the equation for $\Delta P_f$.

In the embodiment disclosed, the fuel pump 38 is an engine-driven pump capable of delivering fuel with pressure to 200 psig. The fuel is supplied to the high pressure pump 38 from an in-tank boost pump 35 at about 7 or 8 psi.

The fuel control pressure regulator or valve mechanism 40 is electrically operated by the electronic computer controller 50. Its function is to regulate the fuel pressure depending on the particular flow requirement. This valve mechanism 40 does this simply by regulating the amount of fuel bypassed back to the fuel tank by a solenoid SOL-1 controlled valve with a control pressure also being provided for varying the displacement of pump 38.

The air meter 8 is one of the key components of the system. The preferred type of meter chosen for this function is the variable area type as disclosed in the above-identified U.S. Pat. application Ser. No. 278,958. The variable flow area of the air meter 8 along with sensors for three parameters: $P_a$, the atmospheric pressure; $\Delta P_a$, differential air pressure across the air valve; and$T_a$, ambient air temperature essentially furnishes input data that permits determination of mass airflow rate. Based upon airflow rate, fuel is metered by controlling the differential pressure across the fuel meter 42 so that the control equation for $\Delta P_f$, described above, is satisfied constantly.

The fuel meter 42 is also a variable area meter and its operation is similar to that of the air valve. The contoured metering rod 46 moves in a fixed orifice 47, thus exposing varying effective areas for the fuel flow. The pressure drop across the orifice 47 is sensed by differential pressure transducer 64 which provides input $\Delta P_f$ to the controller 50 for fuel metering. The metering rod 46 movement is related to the rotation of the air valve 16 by a cam 45 acting against one end of the metering rod. The metering rod 46 and cam 45 contours are scheduled such that the ratio of effective flow areas, $A_a/A_f$, which appears in the above described equation for $\Delta P_f$ is a constant.

The fuel atomizing nozzle 44 delivers a continuous flow of atomized fuel to the engine induction system, preferably, at a single centralized location such as shown in FIG. 1. The nozzle has, preferably, incorporated in it a relief valve so that fuel pressure in the system is always above some critical value, say 40 psig, in order to prevent fuel vaporization in the fuel metering and supply system. With this feature, the fuel is always liquid and two-phase flow conditions should not exist in the fuel metering system.

The electronic computer controller 50 receives signals from the sensors, calculates the governing equation, and operates the fuel control valve mechanism 40 to provide the desired fuel flow rate and pressure to the fuel metering valve 42.

As previously described, the ratio of effective flow areas ($A_a/A_f$) is ideally a constant by virtue of the contour (area schedule) of the air meter and of the metering rod, the latter being positioned by the cam. In an embodiment for a particular engine, the area ratio is taken to be 1995.7 in value which corresponds to the required value with other operating parameters for the operation of the engine having values as given below.

$$\frac{A}{F} = 16 \qquad P_a = 14.7 \text{ psi}$$
$$\Delta P_a = 8'' \text{ H}_2\text{O} \qquad R_a = 53.3 \text{ ft-lb}_f/\text{lb}_m\text{-}^\circ R$$
$$\rho_f = 45.864 \text{ lb}_m/\text{ft}^3 \qquad T_a = 100^\circ\text{F}$$
$$\Delta P_f = 7 \text{ psi}$$

The values of $R_a$ and $\rho_f$ are taken to be constants with values as shown above. Finally, substituting the values of the parameters taken to be constants and arranging the units in common forms results in, $$\Delta P_f = \frac{4166.7315}{(A/F)^2} \; \frac{P_a \, \Delta P_a}{T_a}$$

where the units should be as follows:

$P_a$ - (in. Hg absolute)
$\Delta P_a$ - (in. $H_2o$)
$T_a$ - (°R)
$\Delta P_f$ - (psid)

The above equation for $\Delta P_f$ represents the governing equation for this particular engine and air-fuel metering and induction system. The basic operation of the system with the components indicated must conform to the parameter relations shown in the above equation for $\Delta P_f$. A brief description of the system operation is appropriate at this point.

First, assume that an airflow condition is established by the engine. This induces the air valve servo-mechanism and valve of the air meter assembly 8 to seek an equilibrium position, thus exposing an appropriate effective area, $A_a$, to the airflow to the engine. The air valve 16 movement causes a simultaneous movement in the fuel meter metering rod 46 in the orifice 47 to expose an effective area, $A_f$, to the fuel flow. The areas, $A_a$ and $A_f$, will be in the ratio of $A_a = 1995.7 \times A_f$. At the same time, the computer controller 50 receives signals in the form of voltages representing the values of $P_a$, $T_a$, $\Delta P_a$ and A/F, the latter from programmer 51. From this information, the computer calculates the right-hand side of the equation for $\Delta P_f$. Simultaneously, the computer is also receiving a signal from the differential fuel pressure transducer representing the value of $\Delta P_f'$, the left-hand side of the equation. If the two sides of the equation do not agree, the computer either increases or decreases the current to the fuel control valve mechanism 40 which, in turn, changes the fuel pressure and flow rate to the fuel meter 42 until the two sides of the equation agree. When the equation is satisfied, the fuel atomizing nozzle 44 is then receiving the proper amount of fuel. The system is closed loop and analog so that the computer is receiving the above described sensor inputs and seeking equilibrium at all times.

Referring now to the electrically controlled valve mechanism or pressure regulator 40, this pressure regulator may be any suitable type electrically controlled valve mechanism but, in the embodiment disclosed, this pressure regulator is combined with the pump 38 into a single unit, this unit being an engine driven electrically controlled fuel pump of the type disclosed in copending U.S. Pat. application Ser. No. 419,481 filed Nov. 28, 1973 in the names of Ralph H. Johnston and Leroy E. Lakey, published Jan. 28, 1975 as U.S. Published Pat. Application B 419,481 and assigned to the common assignee of the subject application. This combined fuel pump and pressure regulator is only shown schematically in FIG. 1 since the details of its structure are not required for an understanding of the subject invention and its operation can be adequately described, for the purpose of this invention, by reference to the above-identified schematic illustration. However, for details of the structural elements of this combined fuel pump and pressure regulator, reference is made to the above U.S. Pat. application Ser. No. 419,481 which is incorporated herein by reference.

As shown, fuel line 37 delivers fuel to the pump 38 which is an engine driven, variable displacement, vane type pump. The fuel is delivered to the pump 38 at a predetermined, relatively low pressure from the supply pump 35. Fuel thus delivered to the pump inlet 70 of pump 38 is, upon rotation of the pump shaft 71, delivered through the outlet side of the pump via conduit 72 to the chamber 73 of the regulator housing 74 of pressure regulator 40, the pressure of this fuel corresponding to the outlet pressure of the pump with this fuel then being discharged from the chamber 73 via the conduit 41 to the fuel metering valve 42. The regulator housing 74 of the pressure regulator unit 40 has a spring 75 biased diaphragm 76 separating chamber 73 from a second chamber 77 with the two chambers being interconnected by an orifice passage 78. Thus, as fuel flows into the chamber 73, fuel will also flow from this chamber through the orifice passage 78 into the chamber 77, the fuel in this chamber 77 being at a biased control pressure, a pressure less than the discharge pump pressure in chamber 73. Fuel from the chamber 77 is allowed to flow from a valve controlled orifice 80 by operation of a solenoid SOL-1 controlled valve element 81 for discharge back to the fuel reservoir 36. The operation of the solenoid SOL-1 controlled valve element is such that with no current control signal applied to the coil assembly of the solenoid SOL-1, the fuel in chamber 77 can flow through the valve controlled orifice 80 for recirculation back to the fuel reservoir 36 through the fuel return passage 82, the pressure in this return passage being substantially that of the pressure in the fuel reservoir 36.

During pump operation, as the pressure of the fuel in the chamber 73 increases, it will effect movement of the diaphragm 76 against the action of spring 75 to permit accumulation of fuel in the chamber 73, the diaphragm 76 being connected through a lost motion mechanism, not shown, to a valve 83. Fuel is accumulated in the chamber 73 until the pressure differential on opposite sides of the diaphragm 76 is sufficiently unbalanced to permit movement of the valve 83 from the pressure control outlet 84 from chamber 73 to permit fuel at a thus modulated regulating pressure to be discharged through this outlet 84 and through conduit 85 into the stator chamber 86 on one side of the slider 87 to move the slider 87 in the stator housing 88 of the fuel pump against the biasing action of a spring 90 positioned in the stator housing to engage the opposite side of slider 87 to effect a reduction in the output capacity of the pump and thus reduce the pressure of fuel discharged therefrom. As seen in FIG. 1, the slider 87 is provided with a suitable aperture 91 extending from the inlet side of the pump to the spring side of the slider to permit rapid movement of the slider in one direction and, in addition, as seen in this figure, the lower portion of the stator cavity of the fuel pump is connected by an orifice passage 92 for the bleeding of fuel back to the fuel reservoir 36.

In operation, as an electrical current is applied to the coil assembly of the solenoid SOL-1, the fuel flow becomes more restricted through the orifice 80 of the solenoid control pilot valve assembly 80 and 81 to cause pressure to build up in the chamber 77 to modify the forces applied on opposite sides of the regulating diaphragm 76 so that this diaphragm can be moved in the direction upward, as seen in FIG. 1, by fluid pressure in chamber 77 and by spring 75 to effect closure of the valve member 83, thus closing off the regulating pressure flow of fuel to the stator chamber of the pump, fuel pressure in this portion of the stator chamber being dissipated by bleeding through the sized orifice 93 to the inlet side of the pump, thereby allowing the spring 90 to move the slider 87 in a direction, upward as seen in this figure, to increase the output capacity and therefore the output fuel pressure of the fuel pump 35 to a new regulated output pressure. This regulated output pressure will continue to increase as more control current is applied to the solenoid SOL-1 to permit the pump 35 to deliver fuel at an output pressure and flow which is proportional to the control current applied to the solenoid SOL-1.

As more fully described in the above referenced U.S. Pat. application Ser. No. 419,481, the chamber 73 is in effect an accumulator chamber having an accumulating volume dependent on the movement of the diaphragm 76, without unseating of the valve 83, which movement is determined by the lost motion distance provided by a lost motion mechanism, not shown. Thus, if there is increased flow of fuel through the fuel metering valve 42 to the engine, the pressure of fuel discharged from chamber 73 will tend to decrease and in response to such a drop in pressure, the diaphragm 76 is moved upward, with reference to FIG. 1, by the spring 75 and the control pressure of fuel in the control pressure chamber 77 and, the accumulated fuel in chamber 73 is delivered through the conduit 41 to the fuel metering valve 42.

The air induction unit 10 shown schematically in FIG. 1 would, in accordance with conventional practice, be fabricated as an assembly of various subassemblies including, for example, a throttle body assembly and an air horn assembly, to facilitate the assembly of the various components associated with these subassemblies. Thus, in a preferred embodiment of such an air induction unit, the throttle body assembly, as shown in FIG. 3, would include a throttle body or plate 100 having a central stepped opening 101 therethrough to support the fuel atomizing nozzle 44 in a position so that discharge from this nozzle is downstream of the throttle valves 31 and having a pair of outlet passages 102 positioned on opposite sides of the opening 101 with the axes of the outlet passages 102 and the axis of opening 101 preferably being in a common plane.

Flow through each of the outlet passages 102 is controlled by a throttle valve 31 with each throttle valve being fixed to one of a pair of shafts 103 suitably, rotatably journalled in parallel relation to each other in the throttle plate 100 with at least one or free end of each shaft extending outward from the same side of the throttle plate. Each shaft 103 is journalled so that the axis of rotation of the shaft is offset from the vertical axis through the passage 102 with which it cooperates to provide for unbalanced air pressure forces on the throttle valve 31 mounted on the shaft, the shafts being offset toward each other with respect to the vertical axes of the passages 102 so that, with reference to FIG. 3, the left-hand valve 31 would, if free, rotate clockwise and the right-hand valve 31 would, if free, rotate counterclockwise. Thus, the opening movement of the throttle valves would be in a direction to direct airflow through these passages 102 toward the vertical axis through opening 101 and thus toward the fluid being discharged from the fuel atomizing nozzle 44 to mix therewith.

Figure 3:
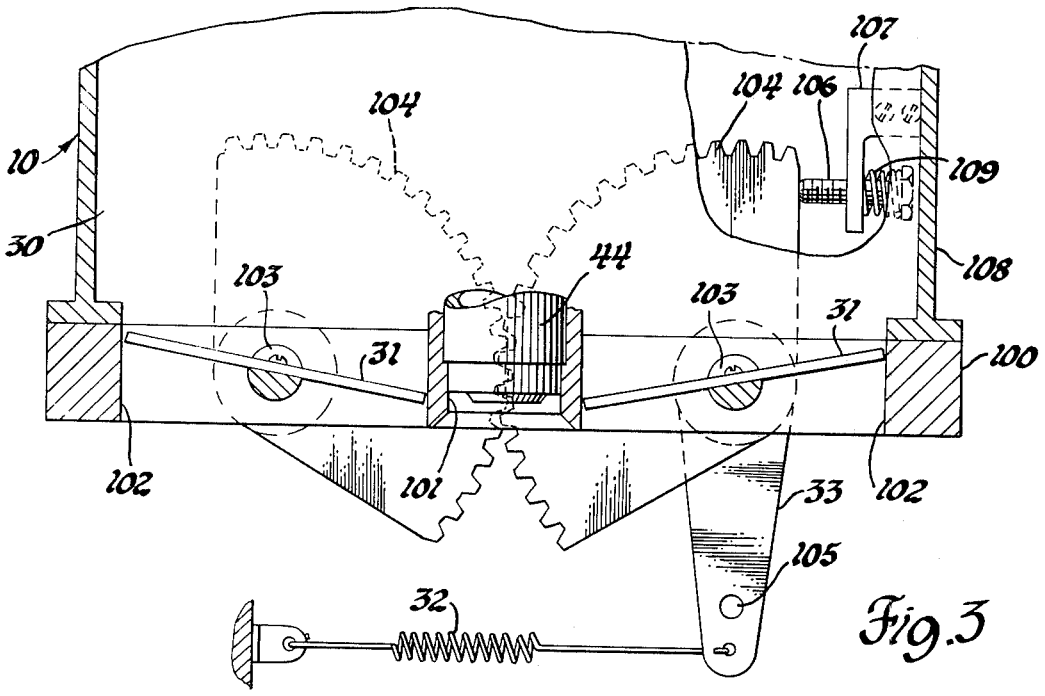

As shown in FIG. 3, the throttle valves 31 are rotated in opposite directions, but in synchronization with each other, by a pair of engaging, segmented gears 104 fixed to the free ends of the shafts 103. The throttle lever 33 fixed to one of the shafts 103, the right-hand shaft with reference to FIG. 3, has an opening 105 to permit this lever to be connected by a link, not shown, to an accelerator pedal, also not shown, in a conventional manner whereby the throttle lever 33 can be rotated counterclockwise to effect opening of the throttle valves. The throttle valve position restoring spring 32, also operatively connected to throttle lever 33, urges the lever 33 in a clockwise direction to effect rotation of the throttle valves 31 into a normal position in which these valves will be nearly closed or an engine idling position, this position being established by an edge of the right-hand gear 104, as seen in FIG. 3, engaging a stop screw 106 threaded into a bracket 107 fixed to the air horn assembly 108 of the air induction unit 10, the stop screw being held in adjusted position by a spring 109.

What is claimed is:

1. A fuel-air supply system for an engine having an air induction passage means provided with a flow control throttle valve, said fuel and air supply system including a mass airflow meter assembly in communication with the air induction passage upstream of the throttle valve and having a pivotable air valve and a servo mechanism operably connected to the air valve and operable as a function of the differential air pressure across said air valve to maintain said differential air pressure substantially constant under all engine operating conditions to essentially effect airflow measurement, a fuel supply means including a fuel pump for supplying high pressure fuel, a fuel atomizing nozzle positioned for discharge into the air induction passage means downstream of the throttle valve, said fuel atomizing nozzle being supplied with air from the air induction passage upstream of the throttle valve and being supplied with fuel from said fuel supply means, an electrically controlled valve mechanism and a fuel metering valve connected in series between said fuel supply means and said fuel atomizing nozzle, said fuel metering valve being operatively connected to said air valve whereby fuel flow through said fuel metering valve is varied as a function of the rotative position of said air valve and, electric circuit means for supplying an electrical signal to said electrically controlled valve mechanism, said electric circuit means having variable means responsive to airflow through said airfow metering means, to a plurality of engine operating conditions and to the differential fuel pressure across said fuel metering valve for controlling the magnitude of said electrical signal.

2. A fuel-air supply system according to claim 1 wherein said fuel pump is a variable displacement pump having a slider movable in a pump housing relative to a pump rotor rotatably journaled in the pump housing for varying the output displacement of said pump, and wherein said electrically controlled valve mechanism is operatively connected to said pump housing whereby to supply fuel at a controlled pressure to said pump housing on one side of said slider to effect movement of said slider as a function of the electrical signal supplied by said electric circuit means.

3. A fuel-air metering and induction system for an internal combustion engine having an intake manifold with an induction passage therein including an air induction means in communication with the induction passage with flow therethrough controlled by at least one throttle valve, a mass airflow metering assembly in communication with the air induction means upstream of said throttle valve, said mass airflow metering assembly including an air valve pivotably positioned in the cylindrical bore of a valve housing having contoured holes of continuous profile, but inverted with respect to each other, and extending from opposite sides of the valve housing to run out at the crossbore, and a servo mechanism operable as a function of the differential air pressure across said air valve to move said air valve to maintain said differential air pressure substantially constant under all engine operating conditions, a fuel supply means including a fuel pump for supplying high pressure fuel, a fuel atomizing nozzle positioned for discharge into the air induction passage means downstream of the throttle valve, said fuel atomizing nozzle being supplied with air from the air induction passage upstream of the throttle valve and being operatively connected to said fuel supply means, an electrically controlled valve mechanism and a fuel metering valve means connected in series between said fuel supply means and said fuel atomizing nozzle, said fuel metering valve being operatively connected to said air valve whereby fuel flow through said meter is varied as a function of the rotative position of said air valve and, electric circuit means for supplying an electrical signal to said electrically controlled valve mechanism, said electric circuit means having variable means responsive to airflow through said airflow metering means, to a plurality of engine operating conditions and to the differential fuel pressure across said fuel metering valve for controlling the magnitude of said electrical signal.

4. A fuel-air metering and induction system for an internal combustion engine having an intake manifold with an induction passage therein, including an air induction means havig an air induction passage therethrough in communication with the induction passage with airflow through said air induction passage controlled by at least one throttle valve, a mass airflow meter including an air metering valve mounted on a rotatable valve shaft positioned upstream of said air induction means, an electrically controlled variable displacement fuel pump having an inlet connected to a source of fuel and having an outlet, a fuel meter having an inlet connected to said outlet of said electrically controlled variable displacement fuel pump and having an outlet, an air atomizing fuel nozzle positioned for discharge into said induction passage downstream of said throttle valve and having a fuel inlet connected to said outlet of said fuel meter, said fuel meter being operatively connected to said air metering valve whereby fuel flow through said fuel meter is varied as a function of the rotative position of said air metering valve, an electronic computer controller operatively connected to said electrically controlled fuel pump to provide an electrical signal thereto for controlling the output volume and pressure of fuel from said electrically controlled fuel pump, engine sensor means responsive to engine operating conditions to produce electrical signals responsive to engine operating conditions, an air-fuel ratio programmer electrically connected to said engine sensor means and providing an electrical output signal to said electronic computer controller in accordance with signals received from said engine sensor means, an air meter sensor means operatively connected to said air meter valve to sense the pressure drop across said air meter valve and the temperature and pressure of air flowing through said air meter valve to provide corresponding electrical output signals to said electronic computer controller and, sensing means to sense the differential fuel pressure across said fuel meter to provide an electrical comparative input signal to said electronic computer controller.

5. A fuel-air metering and induction system for an internal combustion engine having an intake manifold with an induction passage therein, a carburetor housing means having an induction passage therethrough mounted on the engine manifold with its induction passage in communication with the induction passage of said engine manifold, at least one throttle valve pivotably mounted in said induction passage of said carburetor housing for controlling the flow of induction fluid therethrough, a mass airflow meter including an air metering valve rotatably mounted on a pivotable metering valve shaft in a contoured induction passage means upstream of said throttle valve, a fuel reservoir, a fuel pump having an inlet operatively connected to said fuel reservoir and an outlet, an electrically controlled variable displacement fuel pump having an inlet connected to said outlet of said fuel pump and an outlet, a fuel meter having an inlet connected to said outlet of said electrically controlled variable displacement fuel pump and an outlet, an air atomizing fuel nozzle positioned for discharge into said induction passage downstream of said throttle valve and having its fuel inlet connected to said outlet of said fuel meter, said fuel meter having an orifice passage between its inlet and said outlet and a tapered metering rod movably positioned relative to said orifice to control the flow therethrough, a cam on said air meter valve shaft positioned to actuate said tapered metering rod in one direction relative to said orifice and spring means operatively connected to said tapered metering rod to normally bias said metering rod in the opposite direction, an electronic control operatively connected to said electrically controlled fuel pump to provide an electrical signal to control the output volume and pressure of fuel from said electrically controlled fuel pump, engine sensor means to sense engine operating conditions and to provide electrical signals corresponding to the engine operating conditions, an air-fuel ratio programmer electrically connected to said engine sensor means and providing an electrical output signal to said electronic computer controller, an air meter sensor means operatively connected to said air meter valve to sense the pressure drop across said air meter valve and the temperature and pressure of air flowing through said air meter valve and to provide corresponding electrical signals, said air meter sensor means being electrically connected to said electronic computer controller and, sensing means to sense the pressure differential across said fuel meter to provide an electrical input signal to said electronic computer controller.

6. A fuel-air metering and induction system according to claim 5 wherein said carburetor housing means includes a throttle plate having a central aperture for supporting said air atomizing fuel nozzle for discharge downstream of said throttle valve and on opposite sides of said central aperture a pair of outlet passages, a pair of throttle shafts journalled in parallel, spaced apart relation to each other in said throttle plate in position to rotatably support a pair of throttle valves for controlling flow through said passages, gear means connected to said throttle shafts in engagement with each other to effect synchronized, but opposed, rotation of said throttle valves with the rotation of said throttle valves being such as to direct the flow of air through said passages in a direction toward the output of said air atomizing fuel nozzle.

* * * * *